United States Patent [19]

Agathangelou

[11] Patent Number: 4,923,102

[45] Date of Patent: May 8, 1990

[54] GARMENT HANGER

[75] Inventor: Eva Agathangelou, Limassol, Cyprus

[73] Assignee: Cloberleaf Trading Company Ltd., Limassol, Cyprus

[21] Appl. No.: 192,239

[22] Filed: May 10, 1988

[30] Foreign Application Priority Data

May 11, 1987 [GB] United Kingdom ..... 8711039

[51] Int. Cl.[5] ..... A47G 25/62

[52] U.S. Cl. ..... 223/95

[58] Field of Search ..... 223/95, 96, 63, 69, 223/74, 85; D6/315, 317, 326

[56] References Cited

U.S. PATENT DOCUMENTS

| | | | |
|---|---|---|---|
| D. 161,401 | 12/1950 | Wurtz | D6/317 |
| 1,780,153 | 11/1930 | Francsics | 223/95 |
| 2,145,503 | 1/1939 | Anderson | 223/95 |
| 2,168,647 | 8/1939 | Herman | 223/95 |
| 2,488,072 | 11/1949 | Stewart | 223/95 |
| 2,565,630 | 8/1951 | Reynolds | 223/95 |
| 2,853,216 | 9/1958 | Roggentin | 223/95 |
| 3,445,045 | 5/1969 | Panning | 223/95 |
| 3,460,726 | 8/1969 | Rooz | 223/95 |
| 4,600,132 | 7/1986 | Blanchard | 223/95 |
| 4,618,080 | 10/1986 | Shalson | 223/95 |
| 4,746,040 | 5/1988 | Hazenveld | 223/95 X |

FOREIGN PATENT DOCUMENTS

| | | | |
|---|---|---|---|
| 2128079 | 4/1984 | United Kingdom | 223/95 |

*Primary Examiner*—Werner H. Schroeder
*Assistant Examiner*—David K. Suto
*Attorney, Agent, or Firm*—Ladas & Parry

[57] ABSTRACT

A garment hanger has at least a pair of arms on either side of the central stem. Each arm of each pair extends outwardly from a hinge connection with the stem. The hinges of each pair are disposed vertically spaced and at their opposite ends the arms are hingedly attached at spaced points to a garment retaining member. Each upper arm is hinged at a point intermediate of the two end hinge mountings to move outwardly away from the other arm on compression of the ends towards each other and resilient biassing means such as springs in the arms are provided on at least the upper arm to bias the ends of the hanger outwardly. The construction of this hanger becomes the known radial movement of the arms which tend to tilt the garment retaining member at an angle to the original vertical angle resulting in considerable pressure to effect movement of the arms. The hanger of this invention ensures that the garment retaining member remains in a desirable direction.

9 Claims, 1 Drawing Sheet

GARMENT HANGER

BACKGROUND OF THE INVENTION

This invention relates to Garment Hangers.

Garment hangers have been proposed which have variable widths to accomodate garments of different sizes and where the width variation is governed by resilient members which urge outwardly the garment gripping portions at the ends of the hanger to assist in retaining the garments. Thus garment hangers with pivoted arms of resilient material or incorporating spring or other urging means have been suggested. In particular it has been proposed to have a structure in which two arms of resilient material can have the ends pushed together on entering for example the waistband of a garment and on release tend to bias outwards. A simple arm can be provided which can move about a hinge point with bias to the original position. However, in such a structure the radial movement of the arm tends to tilt the garment retaining portion at an angle to the original vertical angle and also considerable pressure is necessary to effect movement of the arms. This tilting has been overcome to some degree by a trapezoidal structure involving two approximately parallel arms. However, in such a structure there is still some movement of the end portion in an undesired direction. In these structures also any movement of the upper arm is parallel to the movement of the lower arm.

SUMMARY OF THE INVENTION

In the present invention there is provided a garment hanger with at least a pair of arms on each side of the hanger, each arm of each pair extending outwardly from a hinge, the hinges of each pair being disposed vertically spaced, each pair of arms being hingedly attached at spaced points to a garment retaining member, each upper arm being hinged at a point intermediate of the two end hinge mountings to move outwardly away from the other arm on compression of the ends towards each other and resilient biassing means on at least the upper arm to bias the ends of the hanger outwardly.

The lower arm can be hingedly attached to the centre portion or at a point outwardly of the centre of the hanger and can be a single piece of polymeric material with sufficient flexibility and resilience at the junction point between arm and each of the hanger and garment retaining member to provide both for hinging and the necessary resilience. The upper arm can also be a single piece of integrally molded polymeric material having sufficient resilience and flexibility at each end to provide for the hinging and the necessary resilience to push the arm outwardly. Preferably the centre of the arm will be slightly angled or curved to provide a further hinging point and resilience, the curve being convex in relation to the lower arm.

The lower arm can also be provided with an intermediate hinge portion providing the hinging such that on movement of the arm about the hinge the hinge moves away from the other arm.

DESCRIPTION OF THE PREFERRED EMBODIMENTS

Figure 1:
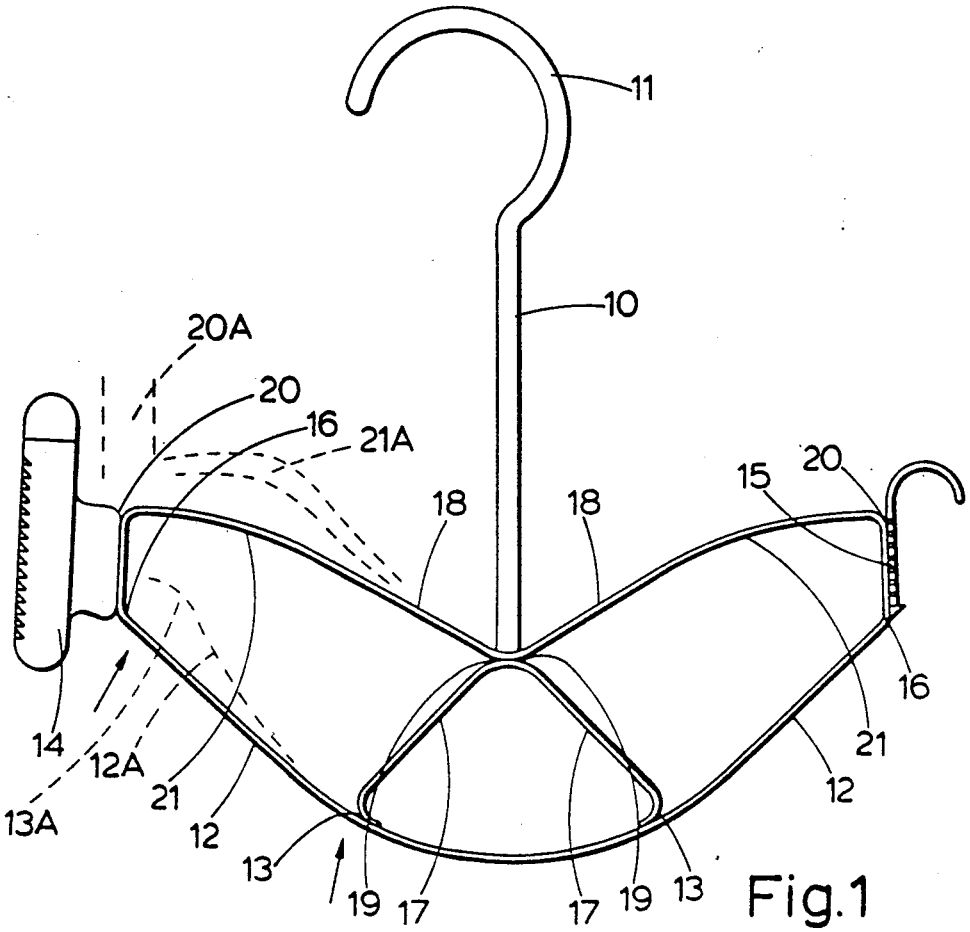
FIG. 1 illustrates a hanger for small garments particularly trousers.

In FIG. 1, there is provide a a central stem 10 with upper hook 11 which is slightly off-center to allow for the weight disposition of a pair of trousers.

A pair of lower arms 12 extend outwardly from the center of the hanger being hinged at the inner attachment to the hanger at hinge points 13 and at the garment retainers 14 and 15 at hinge points 16. Each arm 12 has a hinge point 13A disposed along the arm. Two strengthening arms 17 extend outwardly from the center so resulting in outward disposition of the two hinge points 13.

Two upper arms 18 are hingedly attached to the center at points 19 and to the garment gripping means 14 and 15 at points 20, each arm having a hinge point 21 disposed along the arm. In the case of this structure the hinge point is molded into the arm so as to provide a natural bending point on compression of the two ends 14 and 15 towards each other.

As shown by the dotted lines 12*a* and 21*a* and 20*a*. as the end portion is forced inwardly, the arms bend upward but the hinge in the upper arm causes the hinge portions 21 to move away from the lower arm and to exert forces on the end portions (garment retaining means 14 and 15) which holds said garment retaining means either in the vertically upright position or slightly biasses each end portion so that the lower portion moves inwardly more than the upper portion.

Figure 2:
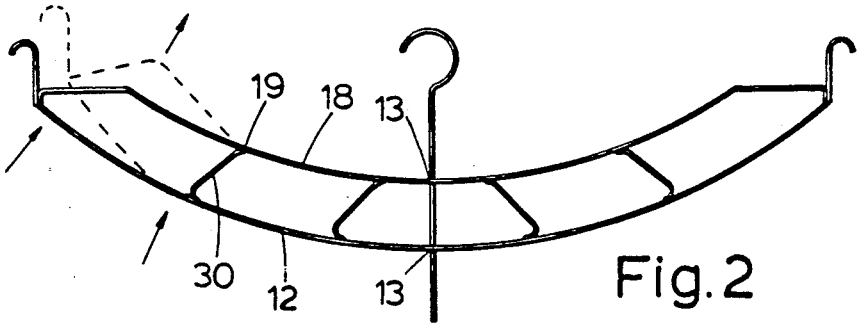
FIG. 2 diagrammatically illustrates a larger size of hanger.

FIG. 2 diagrammatically indicates a structure in which an additional reinforcement 30 is provided outwardly of the center between the upper and lower arms and the hinging points 13 and 19 are at these second pair 30 of reinforcements.

In alternative structures, lower arm 12 could be provided with a hinge intermediate of the two hinging points 13 and 16. Also at least the upper arm could be continuously curved between hinging points 19 and 20 but still give the effect of a hinged arm. Although the structure can be provided by integral moulding in a plastics material which has the necessary resilience in the structure of the arms to provide both hinging and the resilient effect, more rigid arms can be provided with actual hinge elements and separate resilient means for example springs biassing the arms as appropriate. The centre stem 10 could extent to the lower arm 12 so that the hinging elements 13 would then be at the stem 10. For hangers which are designed for heavy garments, arms of plastics material could be provided which are reinforced by internal metallic springs along the whole or a portion of each arm and so disposed within the arms so as to provide the necessary resilience and hinge emements.

The garment gripping members 14 and 15 can be illustrated as serrated members or can be clip members.

The central stem 10 could be mounted on a resilient arm extending between arms 18. Movement of the resilient arms would then move the hook carrying portion and any label upwardly so as to maintain equal distance vertically from the line of the garment retaining portion.

I claim:

1. A garment hanger comprising a support hook and a shank extending from the hook, a pair of elongated arms extending outwardly in opposite directions from the shank, each arm including upper and lower members which are each hingedly attached with the shank, and garment retaining members hingedly attached to the upper and lower members, wherein each upper member is adapted to operate as a hanger at a predetermined point intermediate its ends so that when applying pressure upon the garment retaining members to compress each arm inwardly towards the shank the upper member of each arm hinges at the said hinge point intermediate the opposed ends thereof to increase the spacing between the said upper and lower members, the resilient forces inherent within the upper member being operative to increase the spacing between the upper and lower members respectively, and wherein the lower arm member is provided with a hinge portion intermediate the center of the hanger and an outermost end of each lower member.

2. A garment hanger as claimed in claim 1, wherein the lower member of each arm of the said pair of arms is hingedly attached to a central portion extending between the upper and lower members and the two lower members are together constituted by a single piece of polymeric material.

3. A hanger as claimed in claim 2, wherein the central portion includes strengthening arms connected with the end of the shank remote from the hook, which strengthening arms extend outwardly from the centre to hingedly engage the lower members resulting in outward disposition of the two hinge points.

4. A hanger as claimed in claim 1, wherein the upper and lower members comprise together a single piece of integral moulded polymeric material.

5. A hanger as claimed in claim 1, including garment gripping members in the form of serrated members.

6. A hanger as claimed in claim 1, wherein the centre of each upper member is slightly angled relative to the remainder thereof to provide a further hinging point along the upper arm member.

7. A hanger as claimed in claim 1, wherein each hinge point is moulded into the upper member to provide a natural bending point intermediate the ends of the upper member upon compression of the two ends of the garment hanger towards each other.

8. A hanger as claimed in claim 1, including a central stem comprising a continuation of the shank to extend between the upper and lower members the upper and lower members being pivotable about hinge points at the interconnection of each member and the central stem.

9. A hanger as claimed in claim 8, wherein a resilient arm extending between the upper and lower members is engagable with the upper member at the point of connection of the upper member with the central stem.

* * * * *